United States Patent [19]

Virk et al.

[11] 4,322,387

[45] Mar. 30, 1982

[54] CATALYTIC EXHAUST GAS TORCH

[75] Inventors: Kashmir S. Virk, Hopewell Junction; Martin Alperstein, Fishkill, both of N.Y.

[73] Assignee: Texaco Inc., White Plains, N.Y.

[21] Appl. No.: 200,746

[22] Filed: Oct. 27, 1980

[51] Int. Cl.[3] ..... F01N 3/10

[52] U.S. Cl. ..... 422/174; 422/183; 55/DIG. 30

[58] Field of Search ..... 422/169, 182, 183, 199, 422/174; 60/274, 284, 286, 300, 303; 55/DIG. 30

[56] References Cited

U.S. PATENT DOCUMENTS

| | | | |
|---|---|---|---|
| 3,073,684 | 1/1963 | Williams, Sr. | 422/182 X |
| 3,744,249 | 7/1973 | August | 60/286 |
| 3,796,207 | 3/1974 | Olson | 422/199 X |
| 3,892,536 | 7/1975 | Roeser et al. | 422/169 |
| 3,940,253 | 2/1976 | Zetterström | 422/182 |
| 4,033,123 | 7/1977 | Masaki et al. | 422/183 X |
| 4,169,128 | 9/1979 | Sinor et al. | 422/199 X |
| 4,212,657 | 7/1980 | Urbinati | 55/DIG. 30 |
| 4,257,225 | 3/1981 | Grone, Jr. | 60/274 |

*Primary Examiner*—William A. Cuchlinski, Jr.

*Attorney, Agent, or Firm*—Carl G. Ries; Robert A. Kulason; Robert B. Burns

[57] ABSTRACT

Filter apparatus for filtering combustible particles from an exhaust gas stream, and for periodically rejuvenating the filter bed and catalyst section thereof, by incinerating retained particles. At least a portion of an engine's exhaust gas stream is initially preheated in the catalyst section to raise said section to a predetermined "lightoff" temperature. A supplementary fuel is then introduced to the heated exhaust gas stream prior to the latter entering the catalyst section, thereby causing the fuel/gas mixture to react. Subsequent to initiation of this oxidation reaction, further preheating energy input to increase the exhaust gas to "lightoff" temperature, can be discontinued without affecting the combustible particle incineration rate.

9 Claims, 5 Drawing Figures

FIG. 1
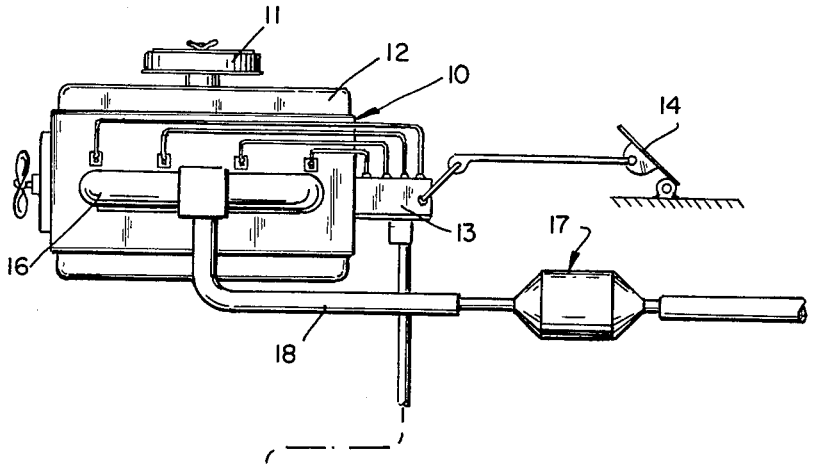
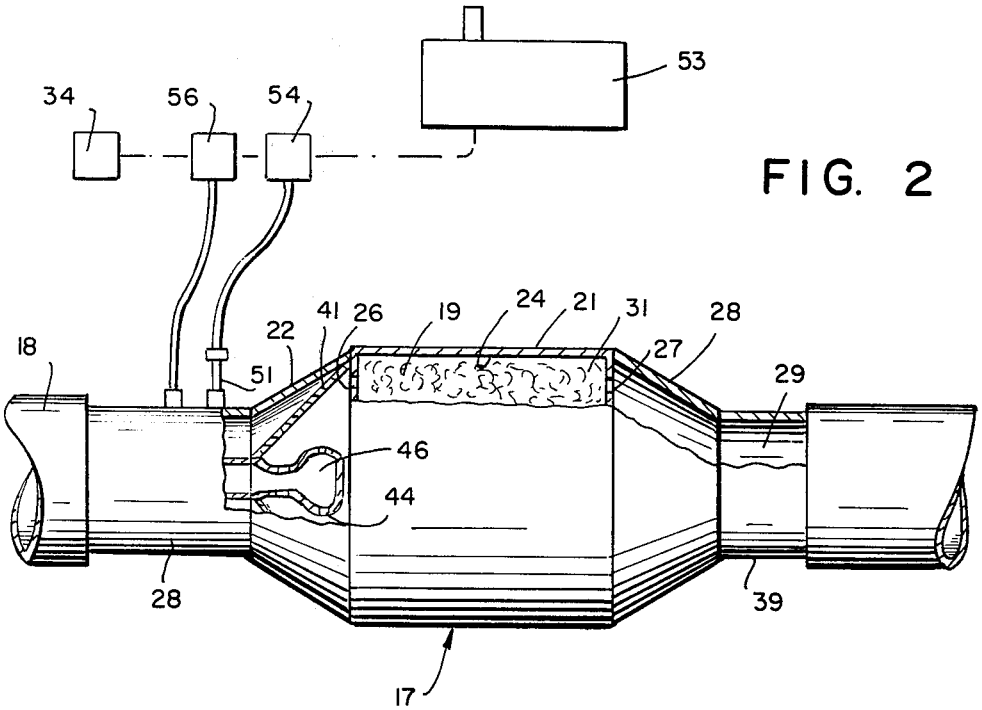
FIG. 2

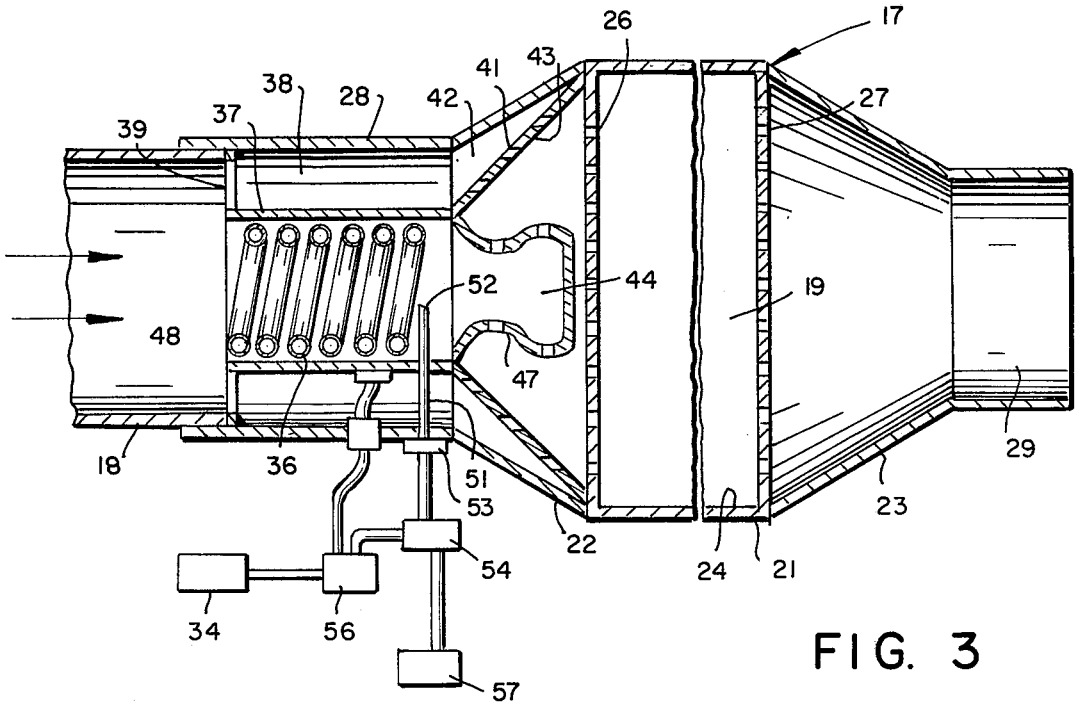
FIG. 3
FIG. 4
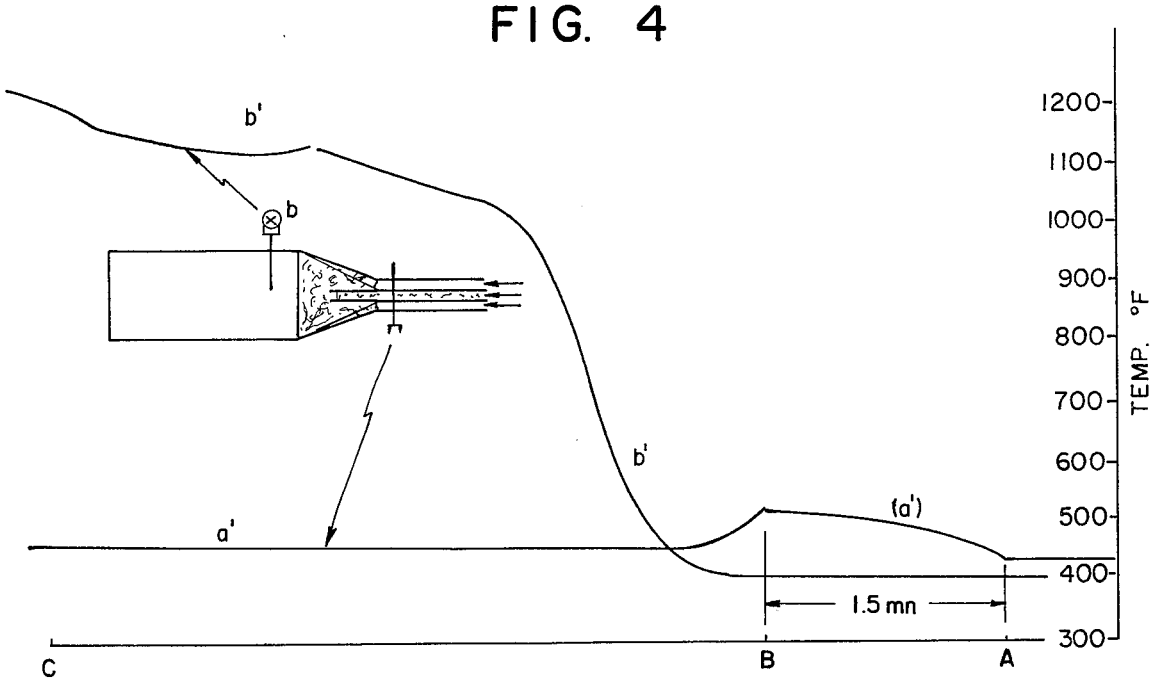

CATALYTIC EXHAUST GAS TORCH

BACKGROUND OF THE INVENTION

With any internal combustion engine it is desirable to treat exhaust gases so that they can be safely discharged into the atmosphere. In some engines, particularly of the diesel type, among the most prevalent operating problems is the presence of particulates which are carried in the exhaust gas stream.

Primarily, the particulates are normally bits of carbon. They result from incomplete combustion of the hydrocarbon fuel under certain engine operating conditions. However, the operating efficiency of the engine is also a contributing factor to the amount of carbon produced.

The presence of relatively large amounts of carbon particles in any exhaust gas stream is evidenced by a dark, smoky, undesirable effluent. Such smoke is not only offensive aesthetically; in large quantities it can be unhealthy.

Means have been provided and are known to the prior art, for the elimination or minimization of the particulate content in exhaust discharge streams. However, it has been found that while the particulates can be eliminated by a suitable filter of proper construction, eventually the latter can become saturated and/or inoperable due to excessive particulate accumulations.

It is further known that the overall engine exhaust gas treating process can be expedited. This is achieved not only by passing the hot gas stream through a filter medium, but by providing the filter with a catalyst which will promote combustion of retained particles.

It should be appreciated that the generation of carbon particles is prevalent under all diesel engine operating conditions. It is further appreciated that the quantity and quality of an exhaust gas stream created in any internal combustion engine will vary in accordance with the operating characteristics of the engine.

For example, the temperature range experienced by a diesel exhaust gas stream can vary between slightly above ambient air temperature, and temperatures in excess of 1200° F. When the exhaust gas is hot enough, carbon particles trapped in a filter will be combusted. However, engine operating conditions at which this rejuvenation can occur is not always attainable in diesel passenger cars, buses or the like.

Where it is found that an engine continuously operates under such circumstances that particulates are continuously produced and accumulated in the filter, the particulate trapping filter bed must be rejuvenated with a degree of consistency.

When the exhaust is sufficiently hot, rejuvenation will consist of merely introducing the hot exhaust gas stream, containing sufficient oxygen, into the filter bed to contact and incinerate retained carbon particles. The combustion of any large, contained carbon accumulation can however, produce temperatures in excess of that of the exhaust gas. The result is that at such excessive temperatures, the filter bed is susceptible to thermal shock, damage or distortion.

Toward achieving an improved and controlled rate of carbon removal from an exhaust gas stream without incurring damage to the filter, the unit presently disclosed is provided.

The instant system thus constitutes in brief, a reaction chamber or filter bed which comprises in part a catalytic segment or section through which the exhaust gas stream flows. This catalytic surface can be incorporated within the particle trapping bed, or can be disposed at the upstream end thereof.

To assure that the main filter bed remains functional in spite of engine operating conditions, a portion of the exhaust gas stream is periodically preheated within an electrically powered heating zone.

This stream is passed into contact with the catalytic segment, thereby raising the temperature of a part of the catalyst segment to the catalyst "lightoff" temperature.

Supplementary fuel is then injected into the heated portion of the exhaust gas to form a fuel/exhaust gas mixture. When the latter contacts the heated catalyst, it will ignite. When the oxidizing action within the catalyst section becomes self-sustaining, the initial electrical heating of the gas stream can be discontinued.

In summary, the main filter bed will be regularly and at periodic intervals, purged or rejuvenated by hot exhaust gas from the catalyst section. Such treatment, if repeated at predetermined times will preclude carbon accumulations which, if not disposed of, might otherwise lead to thermal stress or damage to the filter bed at such time as the accumulation is combusted.

It is therefore an object of the invention to provide a filter of the type disclosed which is capable of retaining combustible particulates from an exhaust gas stream, and of being periodically rejuvenated by incinerating the particulates.

A further object is to provide a particulate filter of the type disclosed which is capable of removing solid combustible elements from an exhaust gas stream while permitting periodic rejuvenation of the filter element.

A still further object is to provide a filter unit for an internal combustion engine, which filter is periodically rejuvenated by supplemental heating means and by introduction of fuel to the filter bed while the engine is operating at conditions that do not result in exhaust gas temperatures sufficiently high to initiate combustion of the supplementary fuel.

DESCRIPTION OF THE DRAWINGS

FIG. 1 illustrates a diesel engine of the type contemplated with which the present smoke filtering system cooperates.

FIG. 2 is an enlarged view in cross-section, of the filter element shown of FIG. 1.

FIG. 3 is an enlarged elevation view of the present filter with a section shown broken away.

FIG. 4 is a graphical illustration of the disclosed filter purging operation.

Referring to FIG. 1, to facilitate description of the present system, an internal combustion engine 10 or other source of exhaust gas, will be considered to be of the diesel type. In the latter, air is sequentially introduced from an air filter 11, by way of manifold 12 to the various combustion chambers.

Diesel fuel is thereafter injected in controlled amounts into each combustion chamber from a fuel pump 13. Fuel flow rate is regulated by control linkage 14.

The hot exhaust gas stream is led from exhaust manifold 16, and conducted through an exhaust pipe 18 to a smoke filter 17. Although a sound absorbing muffler could be inserted into the exhaust pipe, such an element is ancillary to and not essential to the instant system and method of operation.

The exhaust gas stream, subsequent to leaving exhaust manifold 16, will usually be at a temperature within the range of about 200° to 1200° F. The precise temperature will depend on the operating conditions of the engine.

For example, at low and idle speeds, exhaust gas will be relatively cool or only moderately heated. Consequently, as the particle laden exhaust gas stream enters filter 17, the particulates will be retained along the many diverse passages within the filter bed 19.

While the exhaust gas is comprised primarily of a combination of gases, it usually embodies sufficient oxygen content to support at least a limited degree of combustion within the stream itself.

Referring to FIG. 2, in one embodiment, filter 17 comprises an elongated metallic casing 21 having opposed end walls 22 and 23 which define an internal reaction chamber 24. The latter chamber is occupied to a large extent by at least one filter bed 19, formed of material particularly adapted to provide a plurality of irregular flow passages therethrough.

The function of bed 19 is to define a series of passages along which the exhaust gas will flow. During such passage, particulate matter carried on the exhaust stream will be retained on the various passage walls.

Bed 19 can be formed preferably of a metallic mesh-like mass such as steel wool, metal fibrils or the like, which mass is shaped to substantially fill reaction chamber 24.

Bed 19 is preferably supported at its upstream and downstream ends by perforate panels 26 and 27, screens, or other similar rigid, gas permeable transverse members. The latter are positioned at casing 21 wall to support the one or more beds 19 therein particularly when the latter become weakened from heat.

The filter upstream wall 22 is provided with inlet port 28 for preheating and then introducing exhaust gas to the upstream side of bed 19. In a similar manner wall 23 is communicated with a discharge conduit 29 to carry away particle-free gases which leave bed 19.

To best achieve the gas filtering action, bed 19 can be comprised as noted of a suitable gas pervious medium or matrix which is capable of retaining solid particulate matter from the exhaust gas stream. To facilitate the incineration of the retained particles, heated exhaust gas entering the filter will initially heat the catalyst containing conical segment 32 thereof by contact. With the catalyst portion 32 then raised to "lightoff" temperature, supplementary fuel can be added to the heated exhaust to form a fuel/gas combustible mixture.

A part of the catalyst bed 32 now at a temperature of about 450° to 550° F., will receive the fuel/gas mix. The fuel component, whether in liquid or gaseous form, together with the combustion supporting oxygen in the exhaust stream, will thereby be ignited when contacted with the hot catalyst surface.

At such time as the fuel mixture commences to burn, the catalyst bed 32 will no longer require preheating energy. As the combustion of the fuel/gas mixture continues, the filter bed will gradually rise in temperature up to about 1000° to 1300° F.

As the heated exhaust gas stream enters main filter bed 19 from the catalyst segment 32, the gas will be at an elevated temperature approximating that of the catalyst bed. In such an elevated temperature environment, particulate matter which has been retained on the main filter will be incinerated, and bed 19 will be left relatively particle-free.

In accordance with the concepts of the invention, a preferred embodiment of the apparatus provides that the forward or upstream end of filter bed 19 be contiguous with catalyst segment 32. The latter includes a matrix or filter media having a thin layer of an oxidizing catalyst material deposited on the surface.

Although not presently shown, heating segment 32 can be spaced from and upstream of filter bed 19, although not at such a distance that the exhaust gas will experience cooling before it reaches bed 19.

In the present embodiment, as noted, heating catalyst segment 32 is positioned in the forward or upstream portion of casing 21. It extends transversely of the latter to contact substantially the entire hot exhaust gas stream.

Toward achieving the desired preheating of at least a portion of the exhaust gas stream, filter inlet 28 is provided with an electrically energized heater 36. Also included in said exhaust gas preheat section, is a supplemental fuel injector means system.

Referring to FIG. 3, inlet 28 of filter 17 is comprised of a generally elongated tubular conduit which connects to, and defines a continuation to the end wall 22. A second or inner conduit 37 is disposed internally of said conduit 28 to define an annular passage 38 therebetween through which a major portion of the exhaust gas stream flows.

While both members, 28 and 37, are disclosed as being tubular, the exact shape or cross sectional contour thereof is of relatively little consequence since it is only necessary that the respective passages conduct the divided exhaust gas stream toward catalyst bed 32.

Second conduit 37 is supported at its opposed ends by a transverse cage 39 at the forward end which is fixed at its periphery to the inner wall of conduit 28. The conduit 37 downstream end is supported by a generally conically shaped gas deflector 41, the latter being joined about its peripheral rim to the inner wall of casing 21.

Deflector 41 defines a progressively contracting passage 42 with the adjacent filter end wall 22. A series of longitudinally and peripherally spaced openings 43 permit untreated exhaust gas which flows through annular passage 38, to be progressively introduced to the catalytic segment 32.

The downstream end of inner tubular member 37 is communicated with a gas diffuser 44. The latter includes a central chamber 46 defined by an outer wall into which a series of discharge openings 47 are formed. Chamber 46 is positioned to receive the heated flow of fuel/exhaust gas mixture, and to discharge said mixture radially by way of openings 47, into catalytic bed 32. At the latter, the fuel/gas mixture upon contacting the catalyst surface, will either heat the latter, or will immediately ignite if the surface temperature is at or in excess of the "lightoff" temperature.

Heater element 36 is disposed within inlet 28, having a generally round cross section, and positioned to contact at least a small or minor portion of the exhaust gas stream issuing from conduit 18. In the embodiment here illustrated, heater 36 comprises an elongated strip-like member which is conformed to define a substantially cylindrical passage 48 therethrough.

Heater element 36 can also be formed to define a spiral-like configuration through which a portion of the exhaust gas flows whereby the latter will be heated as a result of contact with the guiding heater walls.

In the present arrangement, heater 36 as shown, extends longitudinally of inlet conduit 28 and is preferably coaxial thereto. In either instance, the exhaust gas stream which enters the upstream end of the inlet 28 will be bifurcated. The major part of the flow passes into annular passage 38. A minor portion will enter internal passage 48 defined by the heater.

Heater 36 as shown in FIG. 3, lies contiguous with the inner walls of the second tubular conduit 37. The latter will thereby cause radiating energy to be deflected inwardly, the more effectively to heat the gaseous stream flowing toward diffuser 44. Toward confining the gaseous stream, adjacent coils of heater 36 can be wound sufficiently close to define a substantially closed central passage 48.

Functionally, the major flow of exhaust gas, comprising about 90 to 99 percent by volume, and which enters annular passage 38 from pipe 18, will flow into constricted passage 42 and thence through openings 43 of deflector 41. It will thereafter enter the catalyst filter bed 32. In the latter, this unheated gas segment will be reunited with the minor heated gas flow, thereby to stabilize or lower the temperature of the latter. The minor gas flow can comprise between about 1 to 10 percent by volume of the entire exhaust gas stream.

While heater 36 is here illustrated as being a single electrical element, the specific form thereof can assume any one of a number of shapes or configurations. Further, even though the present embodiment of the heater unit defines a substantially constant cross sectional passage 48, such a configuration is not essential but rather is effective.

For example, and as mentioned, heater 36 can be shaped to define a gradually decreasing cross sectional passage. Further it can extend longitudinally of second conduit 37 to define heated walls against which the exhaust gas stream flows. In any instance, it is cooperatively arranged with diffuser 44 to deliver a hot gas stream to the latter for further dissemination.

Heater 36 is actuated between on and off conditions through an appropriate connection 33. The latter is connected through the wall of conduit 28, to a timing controller 56, and thence to an electrical energy source 34.

The downstream end of passage 48 is provided with fuel injection means adapted to introduce a controlled flow of liquid or gaseous fuel into the heated exhaust gas stream. As shown, at least one injector 51, and preferably a plurality thereof is disposed in diffuser 46 inlet, having a nozzle 52 which terminates in central passage 48. Fuel injector 51 traverses the wall of the inlet conduit 28 and is connected therewith at a terminal 53. The latter is communicated in turn to a source 57 of supplementary fuel.

The fuel utilized for heating exhaust gas can comprise a suitable fluid such as diesel oil, kerosene or in the instance of a gaseous fuel, propane. Further, virtually any fluid which is capable of forming the desired fuel-/exhaust gas mixture capable of being controllably burned, can be utilized in the present instance.

The supplementary fuel circuit includes a pump 54 or similar member which is capable of metering the necessary controlled fuel stream to injectors 51. Timing or metering mechanism 56 functions to periodically actuate the pump. Thus, the filter purging cycle can be programmed to permit injection of a predetermined amount of fuel into the exhaust gas at desired time intervals.

Operationally, the filter purging cycle commences in response to action of the timing mechanism which activates heater 36. The exhaust gas stream flowing from conduit 18 will be divided. A portion thereof will enter passage 48 defined by the heater, and be further raised in temperature.

This exhaust gas preheating step will be continued just so long as is required to bring the temperature of the exhaust gas at the downstream end of the heater 36, to a predetermined temperature level prior to introduction of the gas mixture to catalyst bed 32.

Since the catalyst bed surrounding diffuser 44 will have to be raised to a "lightoff" temperature of approximately 550° F., the initial heating of the gas flow at heater 36 will continue until such a condition is reached within the catalyst bed 32.

Maintenance of the gas preheating period can be established on a programmed timed cycle. Alternately it can occur in response to a temperature rise within catalyst bed 32 as determined by a suitable sensor or thermocouple which can be positioned within bed 17 and connected to timing or control mechanism 56.

When catalyst bed 32 segment has been raised to the desired temperature level, the control means 56 will initiate a flow of fuel through pump 54 and into the respective injectors 51. Thereafter, the heated exhaust gas stream will be provided with sufficient fuel flow to form a combustible fuel/exhaust gas mixture upon entry thereof into diffuser section 46.

From the latter the heated fuel/exhaust gas mixture is introduced by way of discharge opening 47 to the catalyst bed 32 where it immediately ignites to heat all the exhaust streams, causing the temperature of the filter bed to be raised to a level at which retained particles will be combusted.

Referring to FIGS. 3 and 4, the graph of the latter illustrates a compilation of data taken during a test run, to demonstrate the invention. During the test, a stream of hot exhaust gas (420° F.) was introduced to filter inlet 28 (FIG. 3). Temperature measurements were taken at points a and b (FIG. 4) by thermocouples which were positioned within the filter inlet 28 as well as in the filter bed.

Supplementary fuel in the form of propane was added to the minor segment of the exhaust gas stream to form a combustible mixture. Said fuel was injected into the heated gas stream at a rate of 7.5 liters per minute commencing at time B. The minor, heated exhaust stream, was then passed into the filter catalytic segment together with the major portion of the said stream.

Referring to FIG. 4, the thermocouple, fastened at a, is seen to register a steady rise in temperature commencing at point A when the electrical heater was actuated, and during the subsequent 1.5 minute time period to point B.

During this period the electric heater 36 was actuated by the timing mechanism 56. The temperature of the exhaust gas minor segment climbed from 420° F. to about 520° F.

At point B, electric power to heater 36 was discontinued, and the introduction of propane fuel through injector 51 was commenced. When the heated fuel/gas mixture contacted the heated catalyst bed 32, the latter being at "lightoff" temperature, caused the mixture to immediately ignite.

As seen on the chart on FIG. 4, the temperature within the filter at point a and as illustrated on curve a' dropped sharply off when the propane fuel was introduced to the gas stream. This sudden temperature decrease, however, resulted only due to cooling of the thermocouple as a result of its proximity to the nozzle 52, and not to a cooling of the entire fuel/gas mixture.

With the heater 36 deactivated, and with only the fuel/gas mixture being combusted, the temperature within the main filter bed increased sharply. This increase resulted from combustion of particles retained in the filter bed, and was continued until a maximum temperature of about 1200° F. was achieved.

To avoid excessive heating, and possible damage to the filter bed, the flow of propane into the heated gas stream was regulated. Eventually the fuel flow was discontinued (C), at which time the filter bed temperature dropped sharply.

Thereafter, the temperature of the bed was maintained at about the temperature of the exhaust gas stream. Operationally, the cyclic preheating of a part of the exhaust gas stream is repeated preferably on a constant time period. Thus, even though no appreciable amount of carbon particulate matter has been retained in the filter, the latter will nonetheless be periodically purged.

We claim:

1. Filter for treating the exhaust gas stream from an internal combustion engine, which stream carries combustible particulate matter therewith, said filter including;

a casing (21) defining an elongated reaction chamber (24), including a filter media, and having a discharge conduit (29), and an elongated inlet port (28), the latter being adapted to communicate with a source of said exhaust gas, a catalyst bed (32) disposed at the upstream end of said reaction chamber (24) to receive exhaust gas which flows through said inlet port (28), a heater element (36) positioned in said inlet port (28) to contact at least a portion of the exhaust gas stream which flows through the latter, injector means (51) communicated with a source of fuel (57) and having a nozzle (52) which opens into said inlet port (28) at a point downstream of heater element (36) to inject fuel into the heated portion of the exhaust gas stream and thereby form a fuel/-heated gas mixture.

2. In a filter as defined in claim 1, wherein said heater element (36) includes; an elongated electrically actuated member being shaped to define a passage (48) extending longitudinally of said elongated inlet port (28).

3. In a filter as defined in claim 1, wherein said heater element (36) includes; an elongated electrically actuated member, being shaped to define a passage (48) extending coaxial of said elongated inlet port (28).

4. In a filter as defined in claim 1, wherein said heater element (36) includes; an elongated, electrically actuated strip conformed to define a substantially constant cross sectional passage (48) extending longitudinally of said inlet opening (48).

5. In a filter as defined in claim 4, including; a gas diffuser (44) adjacent to said catalyst bed (32), and having a downstream end communicated with said inlet port (28) to receive heated exhaust gas from said passage (48).

6. In a filter as defined in claim 4, wherein said gas diffuser includes; an elongated member which is substantially surrounded by said catalyst bed (32) and said member including a plurality of openings (43) which open into said catalyst bed (32).

7. In a filter as defined in claim 1, wherein said inlet port (28) includes; an outer member defining an elongated cylindrical passage, an inner member (37) positioned internally of said outer member, to define an annular passage (38) and disposed outwardly of said heater element (36).

8. In a filter as defined in claim 7, wherein said annular passage (38) is communicated with said catalyst bed (32) to introduce exhaust gas to the latter.

9. In a filter as defined in claim 7, wherein said annular passage (38) is communicated with the periphery of said catalyst bed (32) to introduce exhaust gas to the outer edges thereof.

* * * * *